US012455073B2

(12) United States Patent
Gilioli et al.

(10) Patent No.: US 12,455,073 B2
(45) **Date of Patent: *Oct. 28, 2025**

(54) COMBUSTION MEMBRANE FOR A GAS BURNER

(71) Applicant: BECKETT THERMAL SOLUTIONS S.R.L., Formigine (IT)

(72) Inventors: Massimo Gilioli, Formigine (IT); Alberto Pezzin, Formigine (IT); Andrea Casoni, Formigine (IT)

(73) Assignee: BECKETT THERMAL SOLUTIONS S.R.L., Modena (IT)

( * ) Notice: Subject to any disclaimer, the term of this patent is extended or adjusted under 35 U.S.C. 154(b) by 489 days.

This patent is subject to a terminal disclaimer.

(21) Appl. No.: 17/966,188

(22) Filed: Oct. 14, 2022

(65) Prior Publication Data

US 2023/0147789 A1 May 11, 2023

(30) Foreign Application Priority Data

Oct. 15, 2021 (IT) ..... 102021000026435

(51) Int. Cl.

| | |
|---|---|
| ***F23D 14/14*** | (2006.01) |
| ***D02G 3/12*** | (2006.01) |
| ***D02G 3/26*** | (2006.01) |
| ***D02G 3/34*** | (2006.01) |
| ***D02G 3/38*** | (2006.01) |

(Continued)

(52) U.S. Cl.

CPC ..... *F23D 14/149* (2021.05); *D02G 3/12* (2013.01); *D02G 3/26* (2013.01); *D02G 3/34* (2013.01); *D02G 3/38* (2013.01); *D02G 3/40* (2013.01); *D02G 3/447* (2013.01); *D10B 2101/20* (2013.01); *D10B 2505/00* (2013.01); *F23D 2203/103* (2013.01); *F23D 2212/201* (2013.01); *F23D 2900/00019* (2013.01)

(58) Field of Classification Search

USPC ..... 431/329

See application file for complete search history.

(56) References Cited

U.S. PATENT DOCUMENTS

2004/0147193 A1* 7/2004 De Waegheneire ..... D02G 3/12 442/376

FOREIGN PATENT DOCUMENTS

| | | |
|---|---|---|
| EP | 1681378 A2 | 7/2006 |
| EP | 2789911 A1 | 10/2014 |

(Continued)

OTHER PUBLICATIONS

Italian Search Report for corresponding IT Patent Application No. 202100026435, mailed Jun. 7, 2022, 7 pages.

*Primary Examiner* — Ko-Wei Lin

(74) *Attorney, Agent, or Firm* — Armstrong Teasdale LLP

(57) ABSTRACT

A combustion membrane (14) for a gas burner (2) comprises a fabric or mesh (21) of interlaced metal threads (22), having two opposite interlacing surfaces (19, 20) which form a combustion surface (19) and an inner surface (20) of the fabric/mesh (21), respectively, wherein the metal threads (22) are formed by twisted metal fibers (22) to form a yarn and:

Figure 1:
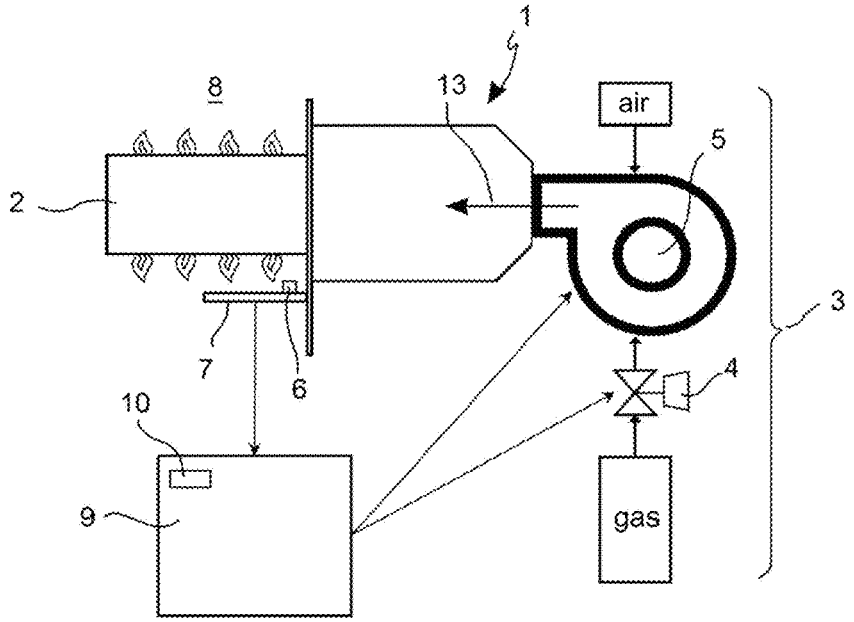

the individual metal fibers (22) are shorter than the yarn (22) formed therefrom, and free ends (22") of the metal fibers (22) protrude divergently from the yarn (22) along its longitudinal extension and make the yarn (22) hairy, and the metal thread (22) is a yarn (22) of mass per length in the range from 0.8 g/m to 1.4 g/m.

13 Claims, 2 Drawing Sheets

(51) Int. Cl.
*D02G 3/40* (2006.01)
*D02G 3/44* (2006.01)

(56) References Cited

FOREIGN PATENT DOCUMENTS

| | | | |
|---|---|---|---|
| WO | 2009015508 | A1 | 2/2009 |
| WO | 2015000869 | A1 | 1/2015 |

* cited by examiner

COMBUSTION MEMBRANE FOR A GAS BURNER

The present application claims the benefit of priority to Italian Patent Application No. 102021000026435, filed on Oct. 14, 2021, the entire contents of which are hereby incorporated by reference.

The present invention relates to a combustion membrane for a burner, in particular for a completely or partially premixed burner, for example for boilers, swimming pool heaters, hot air generators, or ovens for industrial processes.

The burners of the prior art comprise a combustion membrane having:

- an inner surface in flow communication with the feeding system,
- a diffuser layer forming an outer surface (or combustion surface) of the membrane, intended to be facing the combustion chamber, in which the combustible gas or the mixture of combustible gas and combustion supporting air (hereafter in the description, the term "gas" denotes both a "combustible gas" and a "mixture of combustible gas and combustion supporting air") is conveyed through the combustion membrane at the outer side of which combustion takes place, in the form of a flame pattern on the combustion surface.

Furthermore, a distributor may be provided upstream of the diffuser layer (with reference to the flow direction of the gas) to distribute the gas in the desired manner towards the combustion membrane. The known distributors are generally made as walls with a plurality of through openings, for example made of perforated sheet, and may form an "inner" layer of the combustion membrane or alternatively, a component which is spaced apart from the combustion membrane.

The heat generated by the combustion is directed by means of the hot combustion gases (convection) and by means of heat radiation to a heat exchanger to heat a fluid, e.g., water, which is then conveyed to a utility, for example a heating system of an industrial process, residential environments or the like and/or domestic water.

For desirable and satisfactory use of the burner and combustion system, it is desirable, on the one hand, to be able to vary the heating power of the burner and gas flow rate through the combustion membrane in a controlled manner and, on the other hand, to ensure the safest, quietest and longest-lasting operation possible.

To meet the aforesaid requirements in an increasingly satisfactory manner, it is necessary to reduce or prevent some phenomena which may occur during a non optimal combustion process, including:

- a localized or extensive detachment of the flame from the combustion surface,
- a localized or extensive overheating of the combustion membrane,
- a highly uneven distribution of combustion membrane temperature,
- a highly uneven distribution of gas flow velocity across the combustion membrane,
- a low or reduced thermal insulation function of the combustion membrane or a single combustion membrane layer during burner operation.

These undesirable phenomena cause high combustion noise, limited burner resistance to high temperatures, damage to the burner structure itself, in particular to sheet parts of the combustion membrane, as well as the occurrence of phenomena of lack of flame control.

The causal connections between the aforesaid negative phenomena and their detrimental effects on satisfactory combustion have been extensively described in detail in the technical and patent literature concerning gas burners, and are not repeated here for the sake of brevity.

To reduce or suppress some or all of the listed negative phenomena, it is known to equip gas burners with accessory structures, e.g., inserts or diaphragms, to locally bias the inert masses of the burner and the fluid dynamic conditions of the gas flow and, thus, the fluid dynamic and mechanical behavior of the burner.

These noise reduction accessories must be optimized on a case-by-case basis for the fluid dynamic, mechanical, dimensional, and combustion conditions of the individual burner model, and their efficacy is often limited to undesirably narrow (gas flow) operating ranges.

Therefore, the need is felt for additional means and strategies to improve gas burners, particularly premixed or partially premixed gas burners, and to further optimize combustion performed by means of such burners.

Attempts have been made to respond to the described requirements by making an outer side of the combustion membrane of metal fabric or metal mesh to achieve a desired thermal insulation effect of the combustion membrane and thermal protection of portions of the burner upstream of the combustion membrane, and to achieve a better distribution of the gas permeability of the combustion membrane and finally to achieve better flame stability.

However, the attempts to make meshes and metal fabrics from metal yarns in the desired thickness, permeability and structure configurations have proved difficult, by means of available weaving looms or by means of the available knitting machines, which is why the characteristics of metal fabrics and metal meshes for combustion membranes available to date are considerably limited and dictated by the technological constraints of industrial weaving and knitting technology, and no experimental weaves or knits, crafted with more freely definable interlacing and/or yarn structure characteristics appear to have been experimented. An example is the use for metal fabrics and metal meshes for combustion membranes of only yarns with parallel fibers as smooth and long as the yarn itself, which, according to the inventors, excessively limits the possibilities of defining the functional characteristics of the combustion membrane fabric or mesh in a more targeted fashion.

It is the object of the present invention to provide a new and innovative combustion surface made of mesh or fabric, and combustion membrane for gas burners and a gas burner, having features such to avoid at least some of the drawbacks of the prior art.

These and other objects are achieved by means of a combustion membrane for a gas burner according to claim 1. Some advantageous embodiments are the subject of the dependent claims.

According to an aspect of the invention, a combustion membrane for a gas burner has an inner side, to which combustible gas is conveyed, and an outer side, on which combustion of the combustible gas occurs after it has crossed through the combustion membrane, said combustion membrane comprising a fabric or mesh of interlaced metal threads, said fabric or mesh having two opposite interlacing surfaces, which respectively form a combustion surface exposed on the outer side and an inner surface facing towards the inner side, wherein the metal threads are formed by twisted metal fibers to form a spun yarn and:

- the individual metal fibers are shorter than the yarn formed therefrom, and free ends of the metal fibers protrude divergently from the yarn along its longitudinal extension and make the yarn hairy, or the metal thread is a yarn of mass per length in the range from 0.8 g/m to 1.4 g/m.

By virtue of the use of "large" fibers and/or "large" threads, which are heavy in themselves and diametrically coarse or "puffy" due to their hairiness, it is possible to make similarly "coarse" or "heavy" fabrics and knits which inherently have a lower thread count density per unit area and thus a higher and desired gas permeability, also in the presence of greater thickness (and thus greater thermal insulation properties) and/or greater mass (and thus greater thermal inertia), than the "light" or "thin" fabrics of the prior art.

Figure 2:
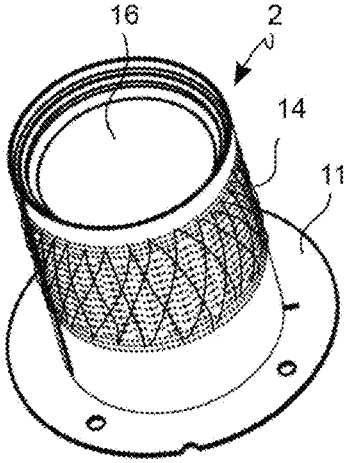
Figure 3:
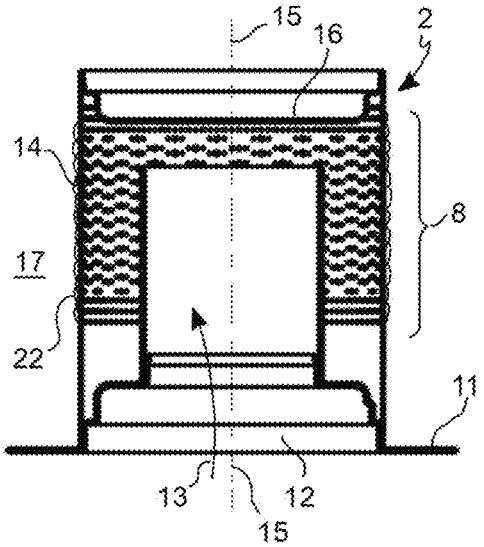
Figure 3A:
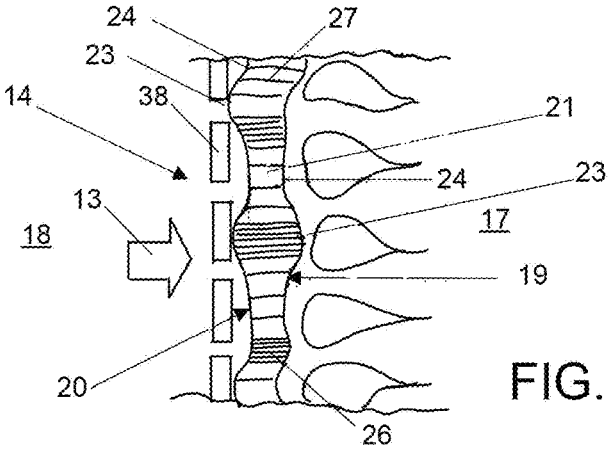
Figure 4:
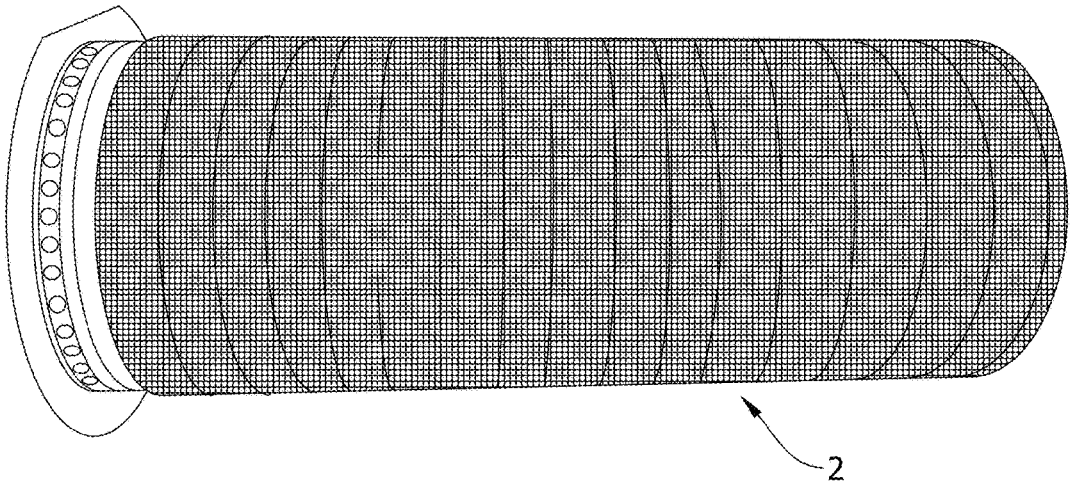
Figure 5:
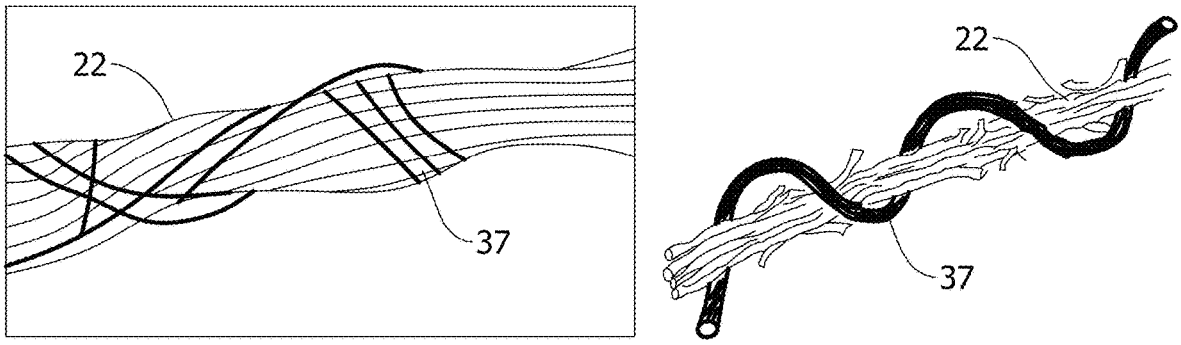
Figure 6:
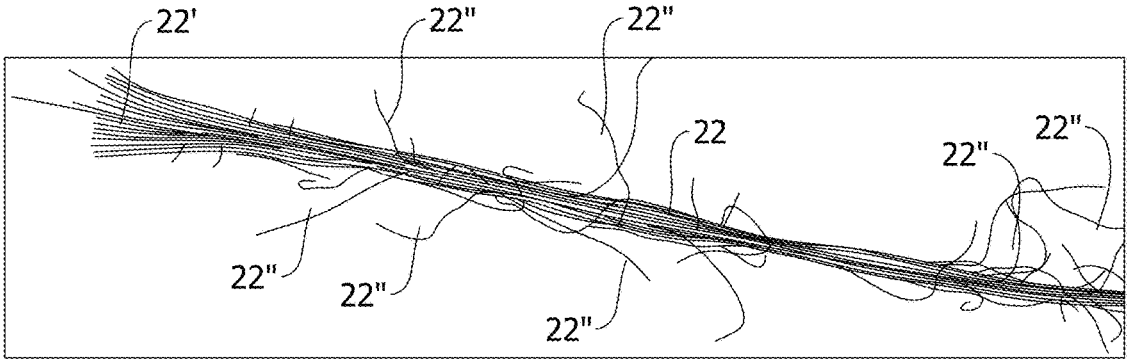

In order to better understand the invention and appreciate the advantages thereof, a description is provided below of certain non-limiting exemplary embodiments, with reference to the accompanying drawings, in which:

FIG. 1 is a diagrammatic view of a gas combustion system, for example for a boiler, with a burner provided with a combustion membrane, FIGS. 2 and 3 are perspective and sectional views of an exemplary burner, provided with a combustion membrane, FIG. 3A is an enlarged and diagrammatic section view of a combustion membrane according to an embodiment of the invention, FIG. 4 shows a burner with a combustion membrane according to an embodiment, FIG. 5 shows a detail of a metal thread bound with a binding thread according to an embodiment, FIG. 6 shows a twisted and "hairy" metal thread (a so-called "hairy spun yarn") of the metal fabric or thread mesh according to an embodiment.

DETAILED DESCRIPTION OF THE COMBUSTION SYSTEM 1

With reference to FIG. 1, a gas combustion system 1, e.g., for a boiler, comprises:

a burner 2 for producing heat by means of combustion of combustible gas and combustion supporting air, a feeding system 3 for feeding the combustible gas or mixture of combustible gas and combustion supporting air to the burner 2, said feeding system 3 comprising a gas control device 4 for controlling a flow of the combustible gas (for example, an electrically controllable gas valve or gas conveying means or gas suction means) and, if provided, an air control device 5 (e.g., air conveying means or air suction means, an electric fan, a radial fan, an air valve or gate air valve) to control a flow of combustion supporting air, an electric ignition device 6 for igniting the combustion, e.g., an ignition electrode adapted to generate a spark, possibly, an ionization sensor 7 arranged at a combustion area 8 of the burner 2 and adapted to provide an electrical ionization signal which varies as a function of a combustion condition of the burner 2, an electronic control unit 9 connected to the feeding system 3, the ignition device 6 and the ionization sensor 7, the electronic control unit 9 having a combustion control module 10 adapted to control the ignition device 6 and the feeding system 3 depending on an operating program and user commands and depending on the ionization signal,

Detailed Description of the Burner 2

According to an embodiment (FIGS. 2, 3), the gas burner 2 comprises:

a support wall 11 forming one or more inlet passages 12 for the introduction (of the mixture) of combustible gas 13 (and combustion supporting air) into the burner 2, a tubular combustion membrane 14, e.g., cylindrical, and coaxial with respect to a longitudinal axis 15 of the burner 2 and having a first end connected to the support wall 11 in flow communication with the inlet passage 12, a second end closed by a closing wall 16, and a perforation for the passage of the gas 13 and of the air mixture from inside the burner 2 to an outer side 17 of the combustion membrane 14 where the combustion occurs (combustion area 8).

The burner 2 in FIG. 3 further shows a tubular silencing accessory (without reference numeral), which is optional and could be reduced in size or completely eliminated.

According to a further embodiment, the combustion membrane 14 can be substantially flat, e.g., planar or curved or convex, or however of non-tubular or non-cylindrical shape, and having a peripheral edge connected to the support housing wall 11 in flow communication with the inlet passage 12, as well as a perforation for the passage of the gas 13 or of the gas-air mixture from inside burner 2 to an outer side 17 of the combustion membrane 14 where the combustion occurs (combustion area 8).

In analogy with prior solutions with conventional combustion membranes, according to an embodiment, in the burner 2, upstream of the combustion membrane 14 (with reference to the flow direction of the combustible gas 13) and spaced apart therefrom, a perforated distributor wall can be positioned in order to distribute the combustible gas 13 in a desired manner towards the combustion membrane 14.

Detailed Description of the Combustion Membrane 14

The combustion membrane 14 having an inner side 18 to which a combustible gas 13 is conveyed and an outer side 17 on which combustion of the combustible gas 13 occurs after it has crossed through the combustion membrane 14, said combustion membrane 14 comprising a fabric or mesh, indicated as a whole by reference numeral 21, of interlaced metal threads 22, having two opposite interlacing surfaces 19, 20, which respectively form a combustion surface 19 exposed on the outer side 17 and an inner surface 20 facing towards the inner side 18, wherein the metal threads 22 are formed by metal fibers 22' twisted to form a spun yarn, and:

the individual metal fibers 22' are shorter than the yarn 22 formed therefrom, and free ends 22 of the metal fibers 22' protrude divergently from the yarn 22 along its longitudinal extension and make the yarn 22 hairy, or the metal thread 22 is a yarn 22 of mass per length in the range from 0.8 g/m to 1.4 g/m.

By virtue of the use of "large" fibers and/or "large" threads, which are heavy in themselves and diametrically coarse or "puffy" due to their hairiness, it is possible to make similarly "coarse" or "heavy" fabrics and knits which inherently have a lower thread count density per unit area and thus a higher and desired gas permeability, also in the presence of greater thickness (and thus greater thermal insulation properties) and/or greater mass (and thus greater thermal inertia), than the "light" or "thin" fabrics of the prior art.

The fabric/mesh 21 is advantageously supported by and in contact with a support layer 38, e.g., a perforated sheet or wire mesh support, arranged on the inner side 18 of the combustion membrane 14 and forming part of the combustion membrane 14 itself or forming only a support structure for the combustion membrane 14.

Thus, the combustion membrane 14 can be a single-layer structure (including only the fabric/mesh 21) or a multilayer structure (containing at least fabric/mesh 21 and the support layer 38 (FIGS. 3, 3A).

The fabric/mesh 21 can only consist of a fabric made from warp and weft threads by means of a weaving loom, thus excluding meshes made by interlacing a continuous coil thread.

Similarly, the fabric/mesh 21 can only consist of a mesh made by interlacing a continuous coil thread, thus excluding fabrics made with warp and weft threads using a weaving loom.

Detailed Description of the Metal Thread 22

According to an embodiment, the metal threads 22 comprise bundles of metal fibers 22', e.g., interlaced, spun or twisted, e.g., of the long fiber filament or short fiber filament type.

The metal threads 22 can be at least or only initially bonded by means of a binder, e.g., water-soluble or non-soluble bonding thread 37, e.g., PVA or polyester, or by means of a water-soluble or non-soluble bonding adhesive, e.g., polymeric.

According to an embodiment, the metal threads 22 can be chosen in the group of so-called "Staple Spun Yarn," "Folded Yarn," "Plied Yarn," "Doubled Yarn" as defined, for example, in "Fundamentals of Yarn Technology" © 2003, CRC Press LLC, Chapter 1.2.1, Table 1.1.

Furthermore, in this description, "Plied Yarn" is specifically understood to indicate a yarn consisting of two or more separate subyarns twisted together.

The subyarns, in turn, can each consist of two or more tertiary yarns twisted together, respectively, forming a so-called "multi-folded yarn."

According to an embodiment, the metal threads 22 are not of the "LONG FILAMENT" type.

Advantageously, the fabric/mesh 21 can be a "heavy" or "coarse" fabric or mesh, i.e., having a weight per area either of fabric equal to or greater than 1.3 kg/m$^2$ or in the range from 1.3 kg/m$^2$ to 1.6 kg/m$^2$.

Advantageously, the metal thread 22 is a yarn of weight per length in the range from 0.8 g/m to 1.4 g/m, advantageously from 0.9 g/m to 1.1 g/m, e.g., 1 g/m.

Advantageously, the metal thread 22 consists of fibers with diameters in the range from 30 micrometers to 50 micrometers, e.g., approximately 40 micrometers.

The "big" fibers 22' and "big" threads 22 allow economical and industrially advantageous manufacture of "coarse" fabrics which are not excessively gas impermeable.

According to an embodiment, the material of the metal threads 22 or metal fibers 22' can be, for example, a ferritic steel, or a FeCrAl alloy, e.g., doped by means of Yttrium, Hafnium, Zirconium.

The metal thread 22 may be, for example, a Y, Hf, Zr doped FeCrAl alloy yarn, weighing 1 g/m and composed of fibers 40 micrometers in diameter, i.e., spun yarn, e.g., with 30 to 150 twists per meter, possibly with fiber ends 22' protruding divergently from the yarn 22 so as to be hairy ("hairy yarn"), with fibers 22' shorter than the yarn 22 itself, e.g., with fiber lengths in the range of 7 cm to 30 cm, not necessarily but possibly restrained by means of a binding thread 37, possibly made of PVA or polyester, and having, for example, the same "doped" composition.

| | C | Mn | Si | Al | Cu | Cr | Y | Hf | Zr | P | S | Ti | N | Ni | Fe |
|---|---|---|---|---|---|---|---|---|---|---|---|---|---|---|---|
| Min. | | | | 5.5 | | 19 | 0.03 | 0.05 or 0.03 | 0.03 | | | | | | rest |
| Max. | 0.04 | 0.4 | 0.5 | 6.5 | 0.03 | 22 | | | | 0.03 | 0.03 | 0.5 | 0.02 | 0.3 | |

Description of Surface Profile Characteristics of the Fabric/Mesh 21

According to an aspect of the invention, both interlacing surfaces 19, 20 form ribs 23 in high relief alternating with valleys 24 in low relief, and both the ribs 23 and valleys 24 have an extent, in at least one direction in the plane of the fabric/mesh 21 greater than three, preferably greater than four, times the thickness of the metal threads 22.

By virtue of the ribs 23 in high relief alternating with the valleys 24 in low relief, the metal fabric/mesh 21 of the combustion membrane 14 achieves a technical effect of discrete, repetitive but not continuous spacer, and the thickness of the fabric/mesh itself is not completely filled with metal material, which improves the thermal insulation capacity and allows a gas distribution through the metal fabric/mesh not only in the direction orthogonal to the plane of the fabric/mesh but also in the plane of the fabric/mesh itself.

This avoids overheating of the combustion membrane 14, improves the thermal insulation of the combustion membrane 14, reduces the risk of flame detachment, and improves the distribution of gas flow velocity 13 through the combustion membrane 14.

Description of Permeability Characteristics of the Fabric/Mesh 21

The fabric/mesh 21 is permeable to gas and has localized first areas 26 with reduced permeability alternated with localized second areas 27 with higher permeability than the first areas 26.

According to an embodiment, said first areas 26 and second areas 27 have an extension, in at least one direction in the plane of the fabric/mesh 21, greater than three times, preferably greater than four times the thickness of the metal thread 22.

The difference in gas permeability between first areas 26 and second areas 27 is e.g. visible and verifiable against the light as a difference in light transmission through the fabric/mesh 21.

The first localized areas 26 with reduced permeability alternating with the second localized areas 27 with higher permeability than the first localized areas 26 proved advantageous with reference to a reduction in the risk of flame detachment and with reference to a better distribution of gas flow velocity across the combustion membrane 14.

Advantages of the Invention

By virtue of the use of "large" fibers and/or "large" threads, which are heavy in themselves and diametrically coarse or "puffy" due to their hairiness, it is possible to make similarly "coarse" or "heavy" fabrics and knits which inherently have a lower thread count density per unit area and thus a higher and desired gas permeability, also in the presence of greater thickness (and thus thermal insulation properties) and/or greater mass (and thus thermal inertia), than the "light" or "thin" fabrics of the prior art.

By virtue of the ribs in high relief alternating with the valleys in low relief, the metal fabric/mesh of the combustion membrane achieves a technical effect of discrete, repetitive but not continuous spacing, and the thickness of the fabric/mesh itself is not completely filled with metal material, which improves the thermal insulation capacity and allows a gas distribution through the metal fabric/mesh not only in the direction orthogonal to the plane of the fabric/mesh but also in the plane of the fabric/mesh itself.

This avoids overheating of the combustion membrane, improves the thermal insulation of the combustion membrane, reduces the risk of flame detachment, and improves the distribution of gas flow velocity through the combustion membrane.

The first localized areas with reduced permeability alternating with the second localized areas with higher permeability than the first localized areas proved advantageous with reference to a reduction in the risk of flame detachment and with reference to a better distribution of gas flow velocity across the combustion membrane.

Therefore, the individual aspects of the invention are not only individually significant in solving the problems of the prior art, but a combination thereof provides further synergy.

The invention claimed is:

1. A combustion membrane (14) for a gas burner (2), said combustion membrane (14) having an inner side (18) to which a combustible gas (13) is conveyed and an outer side (17) on which combustion of the combustible gas (13) occurs after the combustion gas it has crossed through the combustion membrane (14), said combustion membrane (14) comprising a fabric or mesh (21) of interlaced metal threads (22) having two opposite interlacing surfaces (19, 20), which respectively form a combustion surface (19) exposed on the outer side (17) and an inner surface (20) facing towards the inner side (18), wherein the metal threads (22) are formed by metal fibers (22') twisted to form a yarn, and:

the metal fibers (22') are shorter than the yarn (22) formed therefrom, and free ends (22") of the metal fibers (22) protrude divergently from the yarn (22) along the longitudinal extension of the yarn and make the yarn (22) hairy, and the metal thread (22) has a mass per length in the range from 0.8 g/m to 1.4 g/m.

2. A combustion membrane (14) according to claim 1, wherein the fabric/mesh (21) has a mass per area in the range from 1.3 kg/m$^2$ to 1.6 kg/m$^2$.

3. A combustion membrane (14) according to claim 2, wherein each metal thread (22) has a mass per length in the range from 0.9 g/m to 1.1 g/m.

4. A combustion membrane (14) according to claim 3, wherein the metal thread (22) consists of fibers (22'), each fiber having a diameter in the range from 30 micrometers to 50 micrometers.

5. A combustion membrane (14) according to claim 4, wherein the material of the metal threads (22) is a FeCrAl alloy doped with Yttrium, Hafnium, Zirconium.

6. A combustion membrane (14) according to claim 3, wherein each metal thread (22) is twisted with from 30 to 150 twists per meter.

7. A combustion membrane (14) according to claim 3, wherein the metal fibers (22') have a fiber length in the range from 7 cm to 30 cm.

8. A combustion membrane (14) according to claim 3, wherein both interlacing surfaces (19, 20) form ribs (23) in high relief alternating with valleys (24) in low relief, and both the ribs (23) and valleys (24) have an extent, in at least one direction in the plane of the fabric/mesh (21) greater than three times the thickness of the metal threads (22).

9. A combustion membrane (14) according to claim 3, wherein the fabric/mesh (21) has localized first areas (26) with reduced permeability, alternated with localized second areas (27) with higher permeability than the first areas (26), wherein both the first areas (26) and the second areas (27) have an extent, in at least one direction in the plane of the fabric/mesh (21), greater than three times the thickness of the metal thread (22).

10. A combustion membrane (14) according to claim 3, wherein the fabric/mesh (21) is supported by and in contact with a support layer (38) arranged on the inner side (18) of the combustion membrane (14).

11. A combustion membrane (14) according to claim 7, wherein the fibers of one same metal thread (22) are further bound together by an additional binder (37).

12. A combustion membrane (14) according to claim 11, wherein the binder is soluble in water.

13. A gas burner (2) comprising a combustion membrane (14), said combustion membrane (14) having an inner side (18) to which a combustible gas (13) is conveyed and an outer side (17) on which combustion of the combustible gas (13) occurs after the combustion gas has crossed through the combustion membrane (14), said combustion membrane (14) comprising a fabric or mesh (21) of interlaced metal threads (22) having two opposite interlacing surfaces (19, 20), which respectively form a combustion surface (19) exposed on the outer side (17) and an inner surface (20) facing towards the inner side (18), wherein the metal threads (22) are formed by metal fibers (22') twisted to form a yarn, and:

the metal fibers (22') are shorter than the yarn (22) formed therefrom, and free ends (22") of the metal fibers (22') protrude divergently from the yarn (22) along the longitudinal extension of the yarn and make the yarn (22) hairy, and the metal thread (22) has a mass per length in the range from 0.8 g/m to 1.4 g/m.

* * * * *